US006695594B1

(12) United States Patent
Pastori

(10) Patent No.: US 6,695,594 B1
(45) Date of Patent: Feb. 24, 2004

(54) VIBRATORY PUMP IMPROVEMENT

(75) Inventor: Aurélio Antonio Pastori, Jundiaí (BR)

(73) Assignee: Industria de Motores Anauger LTDA, Itupeva (BR)

( * ) Notice: Subject to any disclaimer, the term of this patent is extended or adjusted under 35 U.S.C. 154(b) by 92 days.

(21) Appl. No.: 09/762,796

(22) PCT Filed: Jun. 14, 2000

(86) PCT No.: PCT/BR00/00061

§ 371 (c)(1),
(2), (4) Date: Mar. 26, 2001

(87) PCT Pub. No.: WO00/79130

PCT Pub. Date: Dec. 28, 2000

(30) Foreign Application Priority Data

Jun. 22, 1999 (BR) ..... 9903092

(51) Int. Cl.[7] ..... F04B 35/04
(52) U.S. Cl. ..... 417/417; 417/413.1; 417/566
(58) Field of Search ..... 417/412, 413.1, 417/417, 566

(56) References Cited

U.S. PATENT DOCUMENTS 1,640,742 A * 8/1927 Wallace et al. ..... 310/34
4,815,948 A * 3/1989 Aurelio ..... 417/413.1
5,797,733 A * 8/1998 Falk et al. ..... 417/307

* cited by examiner

*Primary Examiner*—Charles G. Freay
(74) *Attorney, Agent, or Firm*—Michael J. Striker

(57) ABSTRACT

A vibratory pump has a frame, a solenoid located in the frame, a moving transmission including a transmission member, a pumping set cooperating including an oscillating cover, an auxiliary pumping chamber between the oscillating cover and the frame, a cupping arranged at an end of the transmission member, an admission chamber, an auxiliary chamber, a vane-type valve for opening and closing inlets of the admission chamber, a pass in which water circulates and a inverted tubular cup in which the solenolid enclosed constitute means for heat exchange that provide cooling of the solenoid, and the pump can be used without auxiliary accessories or with auxiliary accessories, so that the inlets for opening and closing of the admission chamber are exposed to provide a water collection, or the pump is connected to a base for operating as a suction pump, or an adaptor is provided for connecting the inlets to an outlet of another pump to provide a series of pumps located vertically or horizontally near one another.

5 Claims, 5 Drawing Sheets

VIBRATORY PUMP IMPROVEMENT

BACKGROUND OF THE INVENTION

The present invention relates to a vibratory pump, for hydraulic equipment, which has been improved to be better adapted to tubular wells.

A vibratory pump is known, which substantially includes a frame, a solenoid housed in a lower part of the frame, a moving transmission member extending axially to the frame and capable of axially oscillating, wherein the moving transmission member has an end connected to the solenoid, an intermediate section arranged on a flexible support connected to the frame, and an upper end cooperating with a pumping device which Includes a membrane with a central region connected to the transmission member and peripherally located between the frame parts for defining an auxiliary pumping chamber. The pumping device also has pumping outlets extending from the auxiliary pumping chamber. The pump further has a cup provided at the end of the transmission member and operating In a communication seat of the auxiliary pumping chamber with an upper admission chamber. Also, there is a system of opening and closing valves of the admission chamber.

This type of pump is designed to be used in regular wells. An inconvenience of such a type of pump is heating of the solenoid pump to undesirable levels. In order to solve such inconvenience several proposals have been made, which, however, have not yet met all requirements.

SUMMARY OF THE INVENTION

It is therefore an object of the present invention to provide a vibratory pump that could be adapted to tubular well.

Another objective of the present invention is to provide the pump with proper cooling means of the solenoid coil.

Another objective of the present Invention is to provide the pump with means such that it can be used in many ways, in order to comply with different requirements.

In keeping with these objects one feature of the present invention resides, briefly stated, in a vibratory pump which has a vibratory pump has a frame, a solenoid located in the frame, a moving transmission including a transmission member, the transmission member having a first end, an intermediate section, and an opposite end, a base cooperating with the first end, a flexible support block supporting the intermediate section of the transmission member, a pumping the cooperating with the opposite end and including an oscillating cover having a smaller base connected with the transmission member and a larger base housing the flexible support block, means forming an auxiliary pumping chamber defined between the oscillating cover and the frame and having pumping outlets, a cup arranged at the opposite end of the transmission member, a seat in which a cupping located at the opposite end of the transmission member, an admission chamber, a seat in which the cupping operates and which communicates the auxiliary pumping chamber with an admission chamber, a vane-type valve for opening and closing inlets of the admission chamber, an inverted tubular cup, the solenoid being located, wherein the solenoid is located in an upper region of the frame and housed within the inverted tubular cup, wherein the transmission member with the pumping set and the inlets for opening and closing the admission chamber being located in a lower region of the frame, wherein the inverted tubular cup defines an annular pass with a wall of the frame and having an upper end communicating with a pumping upper outlet of the frame and a lower end communicating with pumping outlets which communicate with the auxiliary pumping chamber, wherein the path in which water circulates and the inverted tubular cup in which the solenoid is enclosed constitute means for heat exchange that provide cooling of the solenoid, wherein means is provided alternatingly using the pump without auxiliary accessories or with auxiliary accessories, the means being formed so that the inlets for opening and closing of the admission chamber are exposed to provide a water collection, or the pump is connected to a base for operating as a suction pump, or an adaptor is provided for connecting the inlets to an outlet of another pump to provide a series of pumps located vertically or horizontally near one another, a base, the base connectable to the frame for operating as a suction pump, and the adaptor provided with an inlet connectable to an outlet of the other pump.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
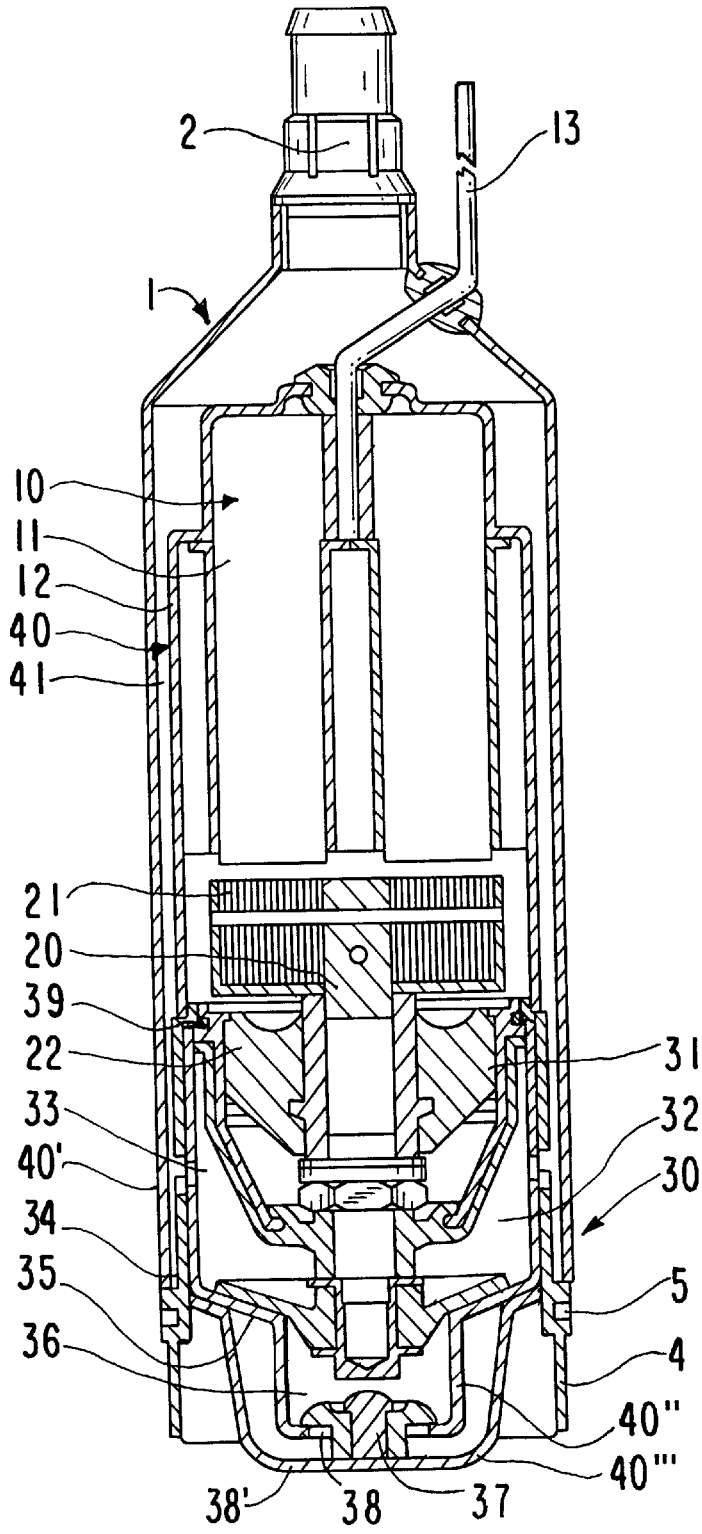
FIG. 1 shows the pump in accordance with the present invention both laterally and in section.

A vibratory pump shown in the drawings and described herein above is provided for water pumping. It includes a frame 1; a driving solenoid 10 housed in the frame; a set of moving transmission, composed of a member 20, axial to the frame, capable of axially oscillating and having an end which is connected to a base 21 of the driving solenoid 10. The intermediate section of the member 20 is located in a flexible support block 22. The opposite end of the member 20 cooperates with parts of the pumping set 30, which includes an oscillating cover 31 with a smaller base cooperating with the member 20 and a larger base that houses the support block 22 and located between the fixed parts of the frame set 1. An auxiliary pumping chamber 32 is defined by the oscillating cover 31 and parts of the frame set. Pumping outlets 33 extend from the auxiliary pumping chamber 32. A cupping 34 is assembled in the opposite end of the transmission member 20. A seat 35 communicates the auxiliary pumping chamber 32 with an admission chamber 36. A system of valves of vane type 37 is provided for opening and closing inlets 38 of the admission chamber 36 and are subject to pressure In the inner part of the same during movement of the cupping 34.

The present invention provides the pump with a diameter that is smaller than the diameter normally observed, it is proper for housing the same Inside the tubular well, and the frame 1 and all mechanism are radially reduced and compensated, so as to be adapted to the tubular well and to keep the pump output within the proper standards.

Another improvement consists in providing a pump with the driving solenoid set 10 for a cooing device with inverting the mechanism position, so that the solenoid 10 is located in the upper region of the pump and housed within the inverted tubular cup 40. The transmission member 20 of the solenoid the pumping set 30 of the transmission member 20, and the water intakes 38 are disposed in the lower region of the pump. The inverted tubular cup 40 defines an annular pass 41 in connection with the frame 1, whose upper end communicates with the upper pumping outlet 2 of the frame 1 and the lower end of the pass 41 communicates with the pumping outlets 33 communicating with the auxiliary pumping chamber 32 of the pumping set 30. The pass 41 with circulating water in the same and the cup wall 40 that encloses the driving solenoid 10 constitute means for heat exchange, that provides cooling of the driving solenoid 10. In order to incorporate the improvement hereinbelow mentioned, the pump has been completely redesigned as described in details hereinafter.

The frame set 1 is composed, essentially, of an external cylindrical frame with external diameter selected to be received inside the tubular well. It is provided with a conical upper end that ends in the pumping outlet 2 and a lower end that has a nozzle 4. In the inner part of the external cylindrical frame the inverted cup 40 is arranged so as to be spaced from the frame and to form the pass 41. It houses the cylindrical solenoid 10 and has a narrower upper section accommodating the end of the solenoid core and a wider lower section extended by the major part of the cup height and accommodating a section of the core and the coil wound in the same, that constitute the solenoid 10. The base 21 of the transmission member 20 is located below and cooperates with the solenoid. The pumping set 30 is located under the base 21 and around the transmission 20. In addition to its pumping function it provides the insulation between the wet and dry parts of the pump.

The pumping set 30 is housed in a cylindrical wall 40' which is a continuation to the cup 40 A peripheral turned edge of the upper base of the cover 31 is located between a pair of upperback steps and the seal ring of a seal set 39, that Includes an upper O-ring is inserted between the base of the cover 31 and the set of wall 40'. The pumping outlets 33 are located in the intermediate region of the set of wall 40' and radially placed. A first closing shaped as a cup 40" has an upper end with a flange that is slightly conical with concave upper end and defines the seat 35, in which the cupping 34 operates. A cylindrical section is formed as a continuation of the flange and defines defines the admission chamber 36 with a bottom having the water intakes 38 and the vane valve 37, controls the latter. A second closing external cup 40'" is provided with a turned edge placed under the flange of the first closing cup 40". Its bottom extends outside the nozzle 4, supports the first closing cup 40" and has holes of water intake 38', lined up with the holes 38 of the admission chamber 36. The first 40" and second 40'" closing cup are assembled so as they can be disassembled by a device that Includes radial tightening devices 5.

The core 11 of the solenoid 10 is cylindrical and has a lower diametrical crack, which defines a double-split section extended for almost a whole core height. The coil 12 is wound with an enameled wire. The core base located in the upper narrow section of the cup 40, does not has the crack and is provided with a through axial hole, in which an electric feeding cable 13 is located. It is extended outside of the bottom of cup 40 and of the upper conical wall of the external frame 1, so as not to be located beyond the projection of the perimeter of the external frame 1 thus making the pump installation in the tubular well easy. The base 21 of the transmission member 20 cooperating with the solenoid 10, is also cylindrical. It is composed of an aggregate of material subject to magnetic attraction and is fastened to the member 20 by means of pins, welding and aluminum.

The pump has three diverse ways of use. In accordance with one of the possibilities (FIG. 1) the pump is used without the auxiliary accessories, assembled in the middle of the tubular well and the water collection is directly made by the inlet openings 38, 38'.

Figure 2:
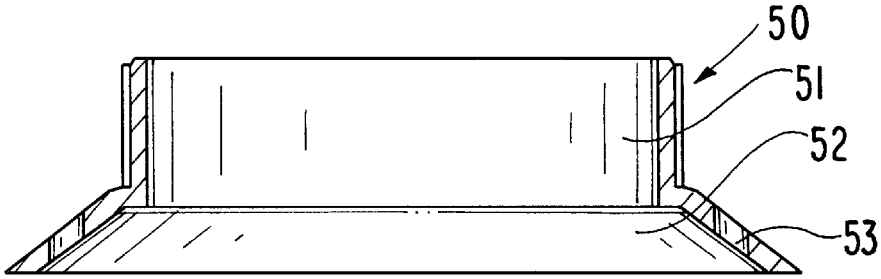
FIG. 2 shows an accessory of the pump in accordance with the present invention, for adapting the same to be used as a suction pump.
Figure 3:
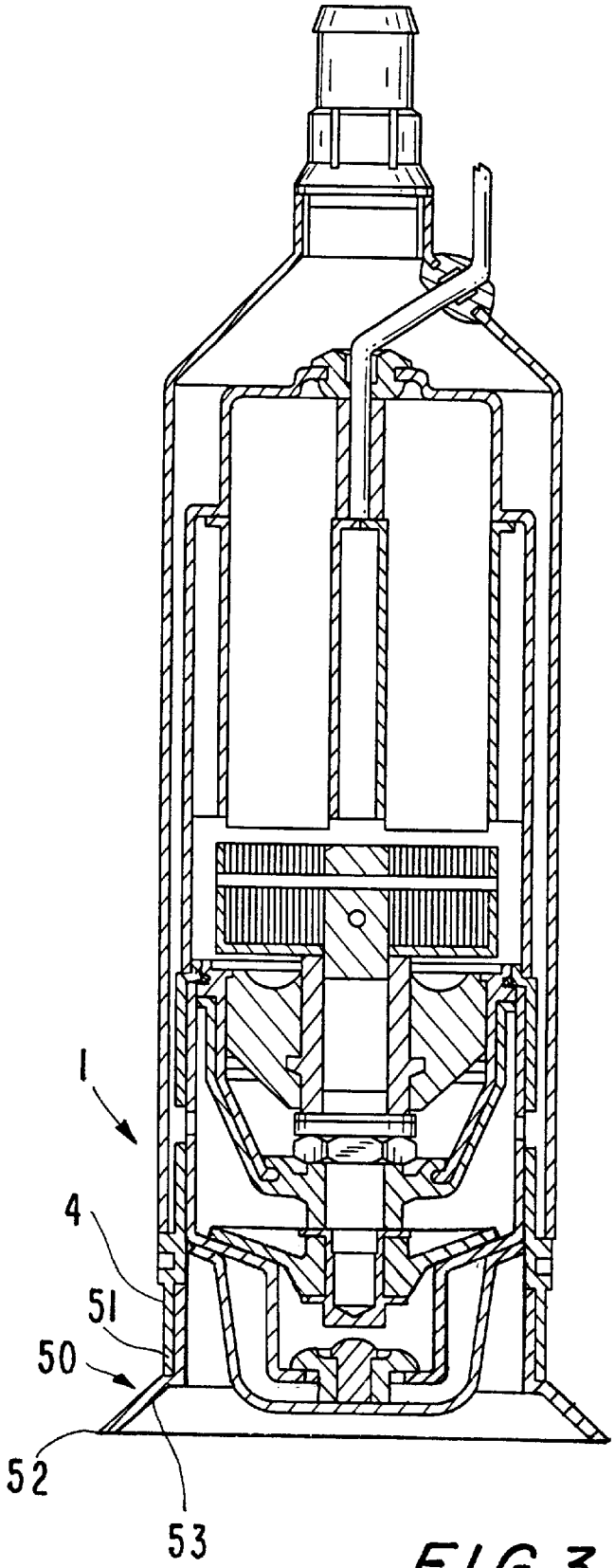
FIG. 3 shows a detail of the pump in accordance with the present invention with the accessory of the previous figure.

In accordance with another possibility, the pump receives in its nozzle 4 a base 50 (FIGS. 2 and 3) to be used as a suction pump. The base 50 is a tubular body including a coupling cylindrical upper section 51 in the nozzle 4 of the pump and a conical-tubular trunk lower section 52, which is extended and widened to be supported in the bottom of the well. It is provided with water intakes 53 close to the upper end of the conical-tubular trunk section 52.

Figure 4:
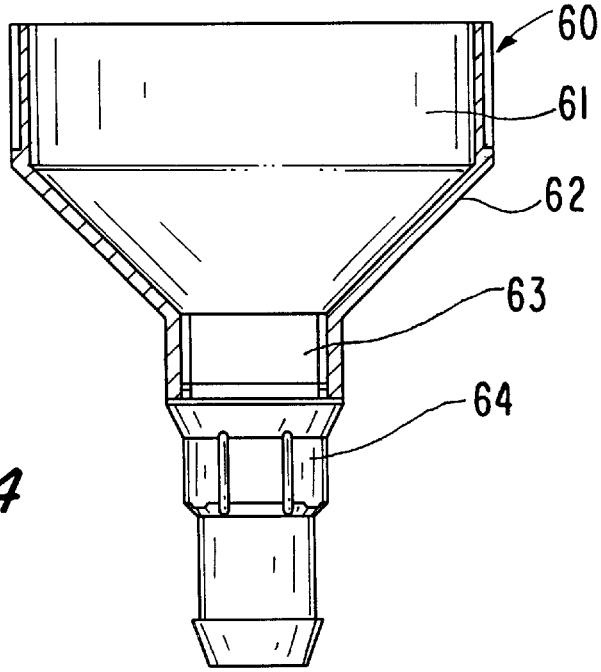
FIG. 4 shows an inlet coupling accessory, for assembly of two pumps in accordance with the present Invention in series.
Figure 5:
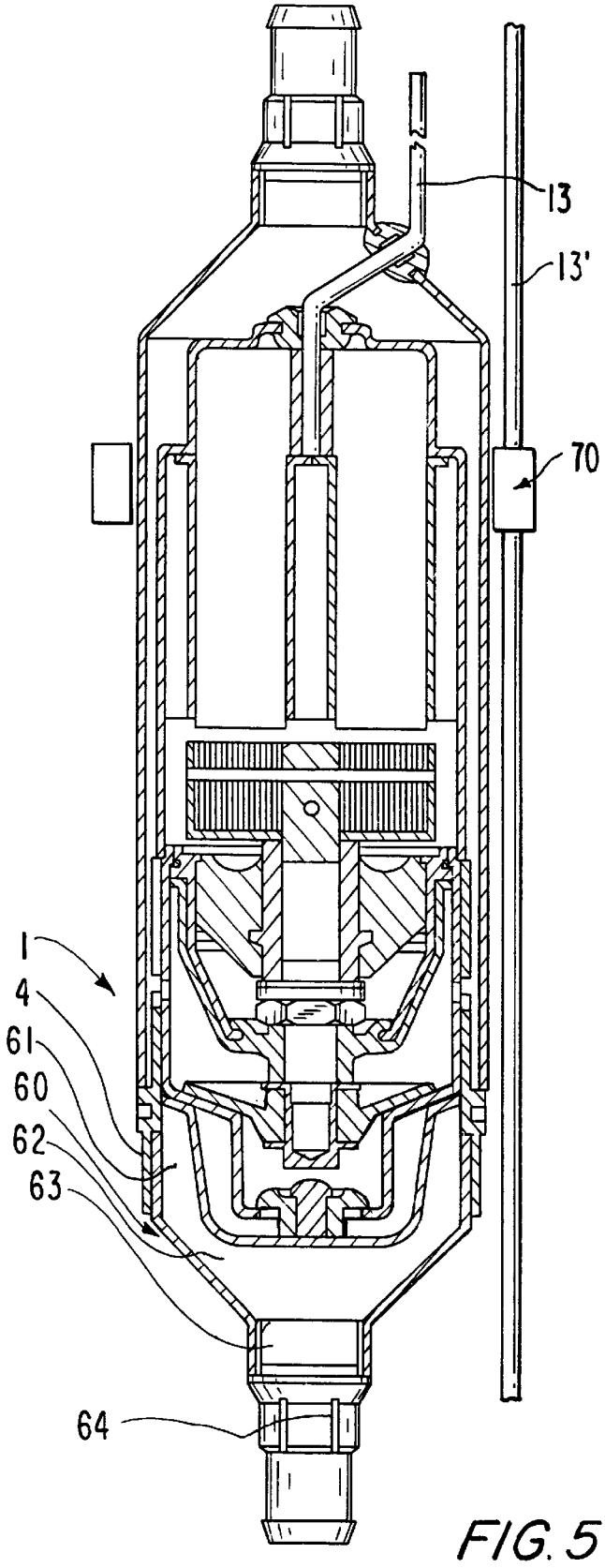
FIG. 5 shows a detail of the pump in accordance with the present invention with the accessory of the previous figure.

In another embodiment, the pump receives a coupling 60 of the nozzle 4 (FIGS. 4 and 5), to connect the pump inlet to the outlet of a second pump, in order to assemble various pumps which are arranged in series vertically spaced from one another, for reaching biggest depths or are horizontally placed for pressurization of the pumping lines. The coupling 60 is a tubular body including a coupling cylindrical end 61 in the pump nozzle 4, an intermediate conical section 62 and a cylindrical extreme section of a smaller diameter 63 for receiving and fastening the connection nipple 64 to a pump outlet. In this way, at least the pumps following the last upstream pump, receive external belts made of rubber-type material 70, to fasten the main electrical feeding cable 13', from which the cables 13 reach the pumps.

In this way, the pump can be properly applied in tubular well, by taking into account the dimensioning proper to such purpose, without reduction of its efficiency.

The cooling device of the present pump, as hereinbefore conceived and described, solves in proper way the solenoid-heating problem, by improving both the pump output and useful life.

The possibility of connecting the pump to different accessories makes possible a wide flexibility of its use, by more completely fulfilling the requirements of the consumer market.

Figure 6:
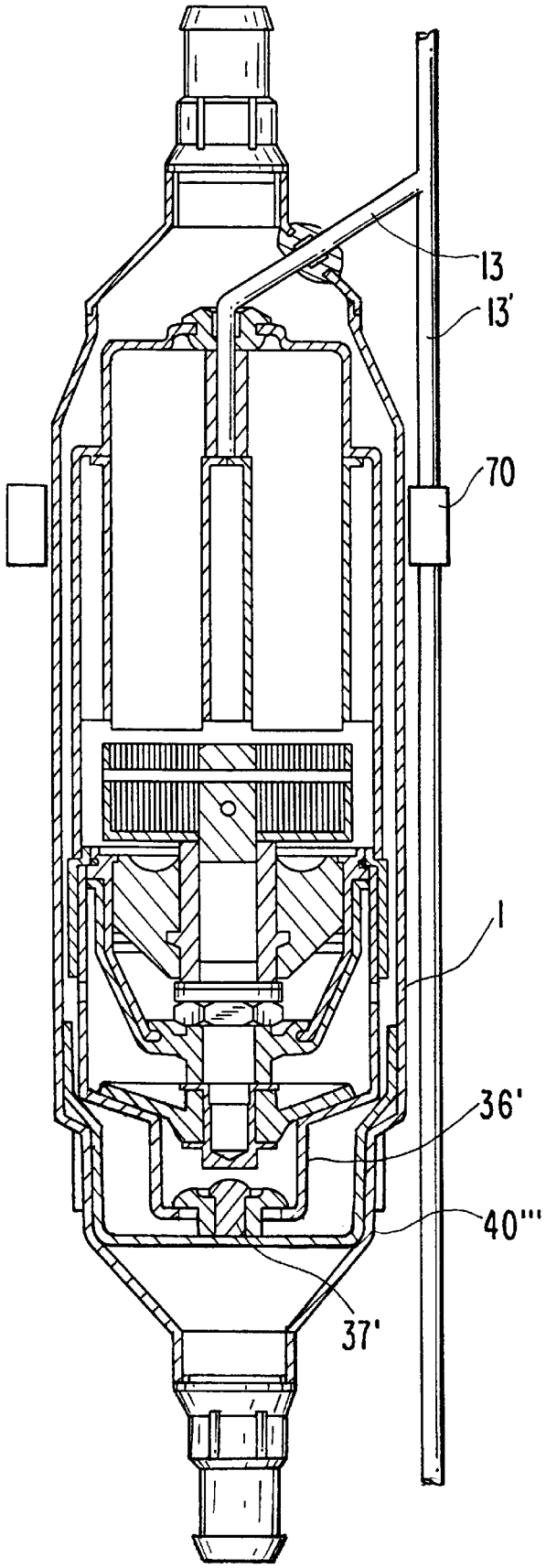
FIG. 6 shows the pump in accordance with the present invention in a version with a frame-made of plastic.

Within the basic conception hereinbefore described, it is changes relating to materials, dimensions and constructive details without leaving the sphere of the requested protection. For this purpose, the pump might have its frame made of stainless steel or aluminum (FIGS. 1 to 5) or of engineering plastic (FIG. 6), solutions which are substantially preserving the same characteristics, yet incorporating only some constructive differences, however related to the possibilities of arrangements resulting from the materials utilized in its construction. Thus, the pump with plastic frame has substantially the same construction of that one made of steel or aluminum, except that it has a second lower closing 40'", which corresponds to the second closing 40: of the other version, comprised by a cup that is coupled to nozzle 4, whose bottom has grate shape and supports the valve 37' admission chamber 36' and is able to receive accessory for connection to the second pump inlet.

The pump, object of the present pioneer patent, is to be used in the field of the hydraulic Installations, particularly those purposed to water pumping, preferably water pumping from tubular well and is yet used for pressurization of pumping lines.

What is claimed is:

1. A vibratory pump, comprising a frame; a substantially vertical solenoid located in said frame; a moving transmission including a transmission member, said transmission member having a first end, an intermediate section, and an opposite end; a base cooperating with said first end; a flexible support block supporting said intermediate section of said transmission member; a pumping set cooperating with said opposite end and including an oscillating cover having a smaller diameter base connected with said transmission member and a large diameter base housing said flexible support block; means forming an auxiliary pumping chamber defined between said oscillating cover and said frame and having pumping outlets; a cupping arranged at said opposite end of said transmission member; means forming an admission chamber; a seat in which said cupping operates and which communicates said auxiliary pumping chamber with said admission chamber; a vane-type valve for opening and closing inlets of said admission chamber; an inverted tubular cup, said solenoid being located in an upper region of said frame and housed within said inverted tubular cup, said transmission member with said pumping set and said inlets for opening and closing said admission chamber being located in a lower region of said frame, said inverted tubular cup defining an annular pass with a wall of said frame and having an upper end communicating with a pumping upper outlet of said frame and a lower end communicating with pumping outlets which communicate with said auxiliary pumping chamber, said pass in which water circulates and said inverted tubular cup in which said solenoid is enclosed constituting means for heat exchange that provide cooling of said solenoid; means for alternatingly using the pump without auxiliary accessories or with auxiliary accessories, said means including a nozzle formed so that inlets for opening and closing of said admission chamber are exposed to provide a water collection, said means further including a base which is connectable to said nozzle for operating the pump as a suction pump, said means further including an adaptor which is also connectable with said nozzle for connecting said inlets to an outlet of another pump to provide a series of pumps located vertically or horizontally near one another.

2. A vibratory pump as defined in claim 1; and further comprising a first cup wall which forms a continuation of a lower end of said cup and has a pair of upper back stops between which a peripheral turned edge of an upper base of said cover is fastened, a seal set located between the base of said cover and said cylindrical wall, wherein said pumping outlets are provided in an intermediate region of said cylindrical wall; a second cup having an upper end cooperating with said first cup and defining said seat in which said cupping operates and also limiting said admission chamber, said water intakes being provided in a bottom of said second cup, and said valve being also located in a bottom of said second cup; and a third cup located under said second cup and having a bottom extending outwardly beyond said nozzle and provided with water intakes which are lined up with inlets of said admission chamber, said second and third cups being releasably connectable and removable by removing devices.

3. A vibratory pump as defined in claim 1, wherein said solenoid has a core which is cylindrical and has a lower diametrical crack defining a double-split section extending over almost a whole height of said core, and coils wound around said core, said core having a base located in said cup and not provided with a crack but instead provided with a through axial hole; an electric feeding cable located in said axial hole and extending outside of a bottom of said cup and an upper conical wall of said frame so as not to be located beyond a projection of a perimeter of said frame, said base of said transmission member being cylindrical and composed of a magnetically attractable material and also is fastened to said transmission member; and means for fastening said base to said transmission member.

4. A vibratory pump as defined in claim 1, wherein said base for operating as a suction pump is a tubular body including a coupling cylindrical upper section in said nozzle and a conical-tubular trunk lower section which is extended and widened and also provided with water intakes at an upper end of said conical-tubular trunk section.

5. A vibratory pump as defined in claim 1, wherein said adaptor is a tubular body including a coupling cylindrical end in said nozzle, an intermediate conical section, and a cylindrical extreme section of a smaller diameter for receiving and fastening of a nipple of a pump outlet, said adaptor being usable with external belts for fastening a main electrical feeding cable from which a cable reaching a pump is extended.

* * * * *